United States Patent [19]

Miller

[11] 4,079,676

[45] Mar. 21, 1978

[54] FREIGHT CAR BODY REINFORCEMENT

[75] Inventor: Roy W. Miller, Highland, Ind.

[73] Assignee: Pullman Incorporated, Chicago, Ill.

[21] Appl. No.: 730,509

[22] Filed: Oct. 7, 1976

[51] Int. Cl.[2] ..... B61D 17/00

[52] U.S. Cl. ..... 105/411; 105/406 R; 105/407; 105/409

[58] Field of Search ..... 105/406 R, 411, 413, 105/414, 396, 404, 407, 244, 247, 248, 249; 296/28 M, 4 D; 52/146, 149, 264

[56] References Cited

U.S. PATENT DOCUMENTS

| | | | |
|---|---|---|---|
| 3,713,399 | 1/1973 | Bembridge et al. | 105/413 X |
| 3,964,399 | 6/1976 | Miller et al. | 105/411 X |
| 4,016,691 | 4/1977 | Cale | 105/406 R X |

*Primary Examiner*—Drayton E. Hoffman
*Assistant Examiner*—Randolph A. Reese
*Attorney, Agent, or Firm*—Thomas G. Anderson

[57] ABSTRACT

A high volume railway gondola car particularly suited for high speed rail operations including a pair of rigid elongated tension and compression braces at each end of the car which couple the corner caps of the car walls to the minimum vertical flexure portions of the car floor located immediately above the car center bearing assemblies.

7 Claims, 4 Drawing Figures

FIG. 3
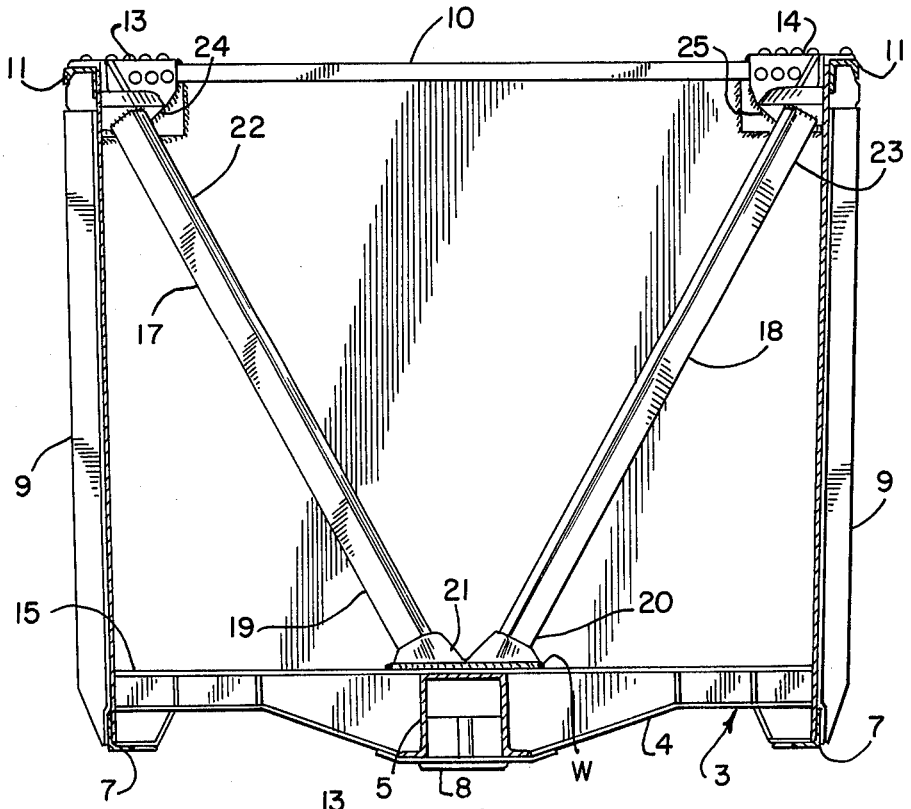
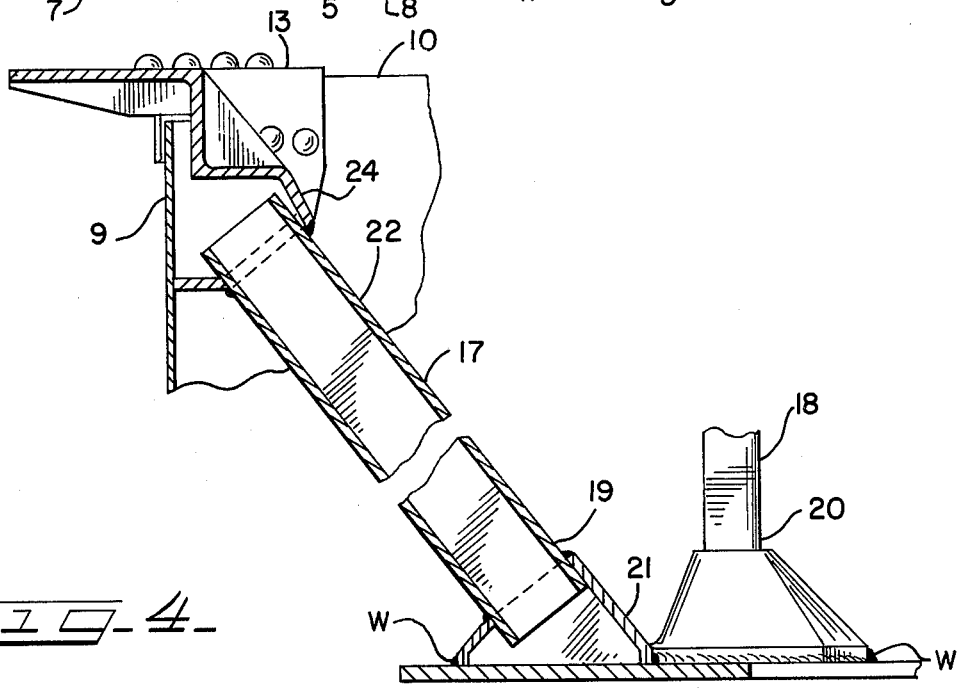
FIG. 4

FREIGHT CAR BODY REINFORCEMENT

BACKGROUND OF THE INVENTION

1. Field of the Invention

The present invention relates to railway freight cars and more particularly to open top gondola cars particularly suited for high speed unit train operations.

2. Description of the Prior Art

As discussed in U.S. Pat. No. 4,024,821 issued May 24, 1977 to Tunghan Yang which is incorporated by reference herein, because of their high side and end wall constructions, high volume gondola cars are less rigid against torsion and therefore vulnerable to severe end-to-end torsional twisting as well as surge loading by the cargo bulk. For this reason, experience has shown that during rail use over rough or high speed tracks, generally oscillatory end-to-end torsional loading on the gondola causes simultaneous lateral and longitudinal oscillatory deflection of the upper portions of the car walls which necessarily dictates and limits the operating speed of the train.

The application cited above discloses a gondola car reinforcing means comprising a pair of crossed diagonal braces which extend downwardly longitudinally inward and substantially laterally across therewithin. Attention is also directed to U.S. Pat. Nos. 2,033,566; 2,146,221 and 2,464,080 which show diagonal bracing extending normal to the wall of a railway car. U.S. Pat. Nos. 789,854 and 1,262,301 show crossbracing parallel to the end wall of a car and coupled to the outboard portions of the car. None, however, solve the problem of rigidifying the car body by diagonal braces which bisect the corners of the car and dump the pulsating car wall deflection loads and vibrations into the minimum vertical flexure portions of the car to effectively resist destructive flexure of the car walls while minimizing structurally fatiguing car body vibrations initiated by the pulsating car wall deflection loads.

SUMMARY OF THE INVENTION

The present invention discloses an improved high volume railway gondola car particularly suited for high speed rail operations.

The invention provides a pair of rigid elongated braces at each end of the car which couple the corner caps of the car walls to the car floor directly above the center plate and bowl assemblies. Each extends downwardly laterally longitudinally inward and is joined to an associated brace as well as the car floor at its lower end to form a truss-like triangular end wall bracing system. By this means, the bracing system effectively prevents torsional twisting of the car walls; and, since the lower ends of the braces are coupled to the minimum vertical flexure points of the car body, the bracing system essentially eliminates leverage amplification and accentuated car body vibration which otherwise would result from the pulsating tension and compression loads generated in the braces by the arrested motion of the car walls. Thus, the invention significantly enhances the structural integrity and high speed roadability of the car.

BRIEF DESCRIPTION OF THE DRAWINGS

FIG. 3 is an enlarged cross-sectional view taken generally along line 3—3 in FIG. 1; and FIG. 4 is an enlarged sectional view taken substantially along line 4—4 in FIG. 2.

DESCRIPTION OF THE PREFERRED EMBODIMENT

Figure 1:
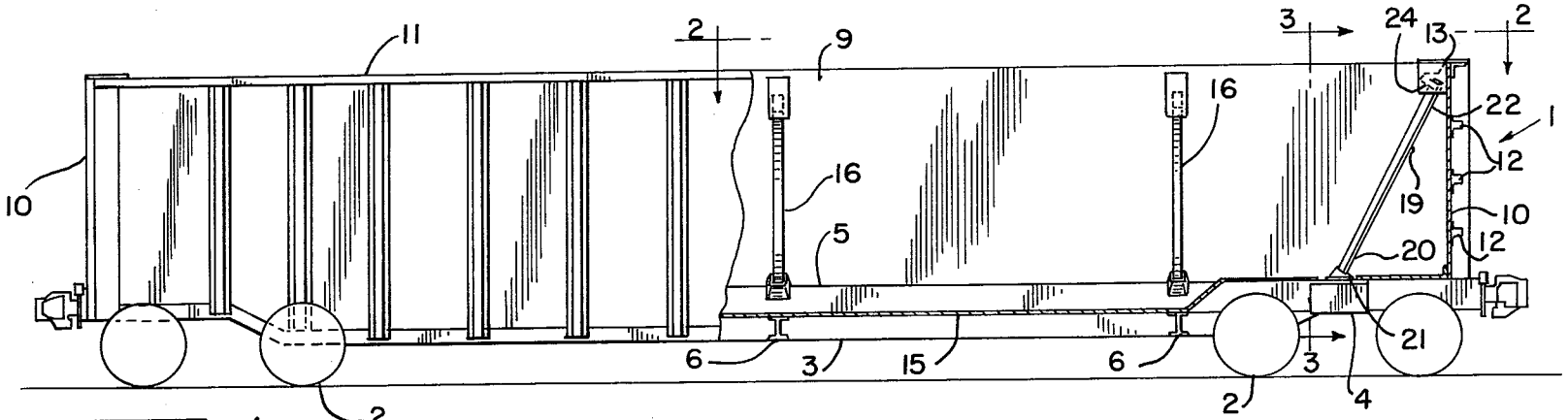
FIG. 1 is a side elevation view of a high volume railway gondola car having part of its side wall cut out to show the triangular truss-like braces of the present invention.
Figure 2:
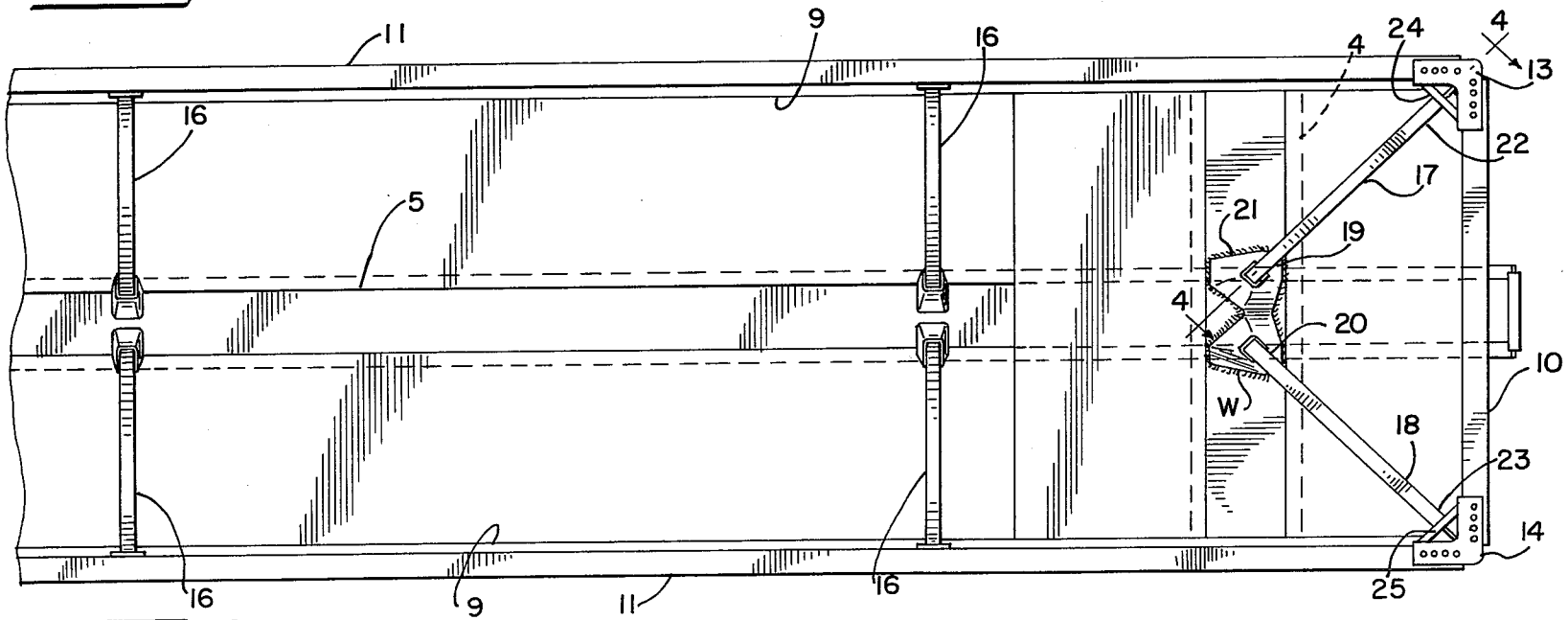
FIG. 2 is an enlarged partial plan view taken substantially along line 2—2 in FIG. 1.

Turning to consideration of the drawings, there shown is a high volume railway gondola car 1 supported on wheel trucks 2. The car 1 has an underframe 3 including transverse bolster beams 4, an elongated center sill 5, and a plurality of longitudinally spaced horizontal cross-bearers 6 which are supported from the center sill 5 and extend outwardly therefrom to longitudinally extending side sills 7. To accommodate pivotal or rotative movement of the trucks 2 on the underframe 3, a conventional center bearing assembly including a car body center plate 8 and truck center plate bowl (not shown in the drawings) is interposed between each truck 2 and the underframe 3.

The gondola car 1 also includes side walls 9 and end walls 10 and the lower ends or edges of the side walls 9 are suitably connected to the side sills 7, and the upper ends or edges of the side walls 9 are connected to the upper side plate 11 longitudinally extending between the end walls 10. The end walls 10 are each rigidified by horizontally extending crossbraces 12 and the upper edges of the side walls 9 and end walls 10 are coupled together by overlying corner members or caps 13 and 14. To enclose the bottom of the car body the car includes floor plating 15, including a depressed center portion intermediate of the trucks 2, carried by the center sill 5, bolster beams 4 and cross-bearers 6. Additionally, side wall members 16 extending parallel to the end walls 10 and rigidly coupling the upper edges of the side walls 9 to the center sill 5 are provided to restrain lateral deflection of the side walls 9.

The invention provides a pair of upwardly and longitudinally diverging rigid braces or reinforcing members 17 and 18 at each end of the car 1. The lower end sections 19 and 20 of the braces 17 and 18 are coupled together above the car body center plate 8 by the lower coupling or attachment member 21 which in turn dumps the tension and compression loads in the braces resulting from the arrested motion of the car walls into the minimum vertical flexure portion of the car underframe bolster 4 and car floor 15. This feature is particularly distinguished from car bracing structure secured to extend substantially across the car since pulsating car wall deflection loads transferred through such braces to the outboard portions of the car floor and underframe result in relatively increased fatigue and instability of the center plate and bowl assemblies which provide the pivotal bearing connections between the car body and the trucks. More particularly, in such structures since the pulsating loads are dumped into the outboard portions of the car floor and underframe structure, the loads are amplified and thus accentuate the characteristic oscillatory lateral warping teeter-totterlike rocking movement of the underframe on the trucks. As a result of this accentuated rocking motion, prematurely fatiguing high stress concentrations can develop in the car body center plates provided in the prior art constructions. Concurrently, structurely deliterious secondary vibrations develop in the underframe which further accentuate rocking of the car body and thus significantly contribute to the instability and reduced roadability of the car.

The upper end sections 22 and 23 are secured or coupled to upper brace attachment couplings 24 and 25 depending from the corner members 13 and 14. Additionally, the downwardly diagonal braces 17 and 18 bisect the respective corners of the car so that the longitudinal axis of the braces are substantially coaxial with the resultant force of lateral and longitudinal car wall corner deflection forces, thereby essentially preventing the development of shearing or bending loads in the braces.

FIGS. 3 and 4 more specifically illustrate the construction of the braces 17 and 18 and the upper and lower couplings 21, 24 and 25 securing the braces to the car. The braces 17 and 18 are of a rigid lightweight tubular construction and the upper end sections 22 and 23 are telescoped within the couplings 24 and 25 and the lower sections 19 and 20 are telescoped within the lower coupling 21 and all of the end sections are welded or otherwise appropriately secured to their respective couplings as generally indicated at *w* in the drawings.

In view of the above and the drawings, it can be seen that the invention provides a torsion arresting triangular truss-like car wall bracing means which restrains destructive parallelogram flexure of the car walls while at the same time retarding or preventing the development of significant secondary vibrations in the underframe leading to premature fatigue and failure of the center bearing assemblies and the vehicle underframe as well as reduced roadability of the car.

The foregoing description and drawings merely explain and illustrate the invention and the invention is not limited thereto, except insofar as the appendant claims are so limited, as those skilled in the art who have the disclosure before them will be able to make modifications and variations therein without departing from the scope of the invention.

What is claimed is:

1. An open top high volume railway car body including a pair of side walls and interconnecting end walls defining vertically extending corner portions, a car underframe connected to a lower portion of said body including center bearing assemblies adapted to support said underframe on longitudinally spaced car trucks, said underframe including a center sill and longtiduinally spaced transversely extending horizontal support means supported on said bearing assemblies, the intersection of said center sill and said horizontal support means defining minimum vertical flexure portions a V-shaped truss including a pair of elongated braces bisecting respective corner portions and lying in a plane inclined relative to the end wall in upwardly converging relation thereto lengthwise of the car, said braces including upper end sections connected to respective corner portions and lower end sections terminating in the apex of said truss adjacent a respective minimum flexure portion, and lower coupling means rigidly interconnecting said lower end sections and securing them to the underframe of the car.

2. The invention according to claim 1, and said horizontal support means having a laterally extending bolster beam.

3. The invention according to claim 1, and said horizontal support means having longitudinally spaced longitudinally extending stub sills.

4. The invention according to claim 1, and said horizontal support means including a floor having a depressed center portion intermediate the trucks.

5. The invention according to claim 1, and said braces each being a rigid elongated tension and compression member resisting inward and outward deflection of said car walls.

6. The invention according to claim 5, and said braces having a longitudinal axis substantially coaxial with the resultant force of lateral and longitudinal car wall corner deflection forces, thereby essentially eliminating shearing and bending loads in said braces.

7. The invention according to claim 1, and upwardly diagonally extending bracing means parallel to said end walls and spaced therebetween rigidly coupling said side walls and said horizontal support means.

* * * * *